US009062431B2

(12) United States Patent
Koehler et al.

(10) Patent No.: US 9,062,431 B2
(45) Date of Patent: Jun. 23, 2015

(54) DEVICE AND METHOD FOR SOIL COMPACTION AND/OR SOIL STABILIZATION

(71) Applicants: Ulf Koehler, Weimar (DE); Joerg Gnauert, Rotenburg (DE)

(72) Inventors: Ulf Koehler, Weimar (DE); Joerg Gnauert, Rotenburg (DE)

( * ) Notice: Subject to any disclaimer, the term of this patent is extended or adjusted under 35 U.S.C. 154(b) by 12 days.

(21) Appl. No.: 14/136,982

(22) Filed: Dec. 20, 2013

(65) Prior Publication Data

US 2014/0178132 A1 Jun. 26, 2014

Related U.S. Application Data

(60) Provisional application No. 61/739,734, filed on Dec. 20, 2012.

(51) Int. Cl.
*E02D 3/054* (2006.01)

(52) U.S. Cl.
CPC ..... *E02D 3/054* (2013.01)

(58) Field of Classification Search
CPC ..... E02D 3/054; E02D 3/02; E02D 3/046
USPC ..... 405/258.1, 271; 173/113
See application file for complete search history.

(56) References Cited

U.S. PATENT DOCUMENTS

| | | | | | |
|---|---|---|---|---|---|
| 3,865,501 | A * | 2/1975 | Kniep | 404/133.05 |
| 4,015,433 | A * | 4/1977 | Shibata | 405/259.5 |
| 4,193,461 | A * | 3/1980 | Lamberton et al. | 175/19 |
| 4,843,785 | A * | 7/1989 | Sero et al. | 52/160 |
| 5,622,015 | A * | 4/1997 | Collins | 52/160 |
| 7,093,673 | B2 * | 8/2006 | Stokka | 175/40 |
| 7,621,098 | B2 * | 11/2009 | Reinert, Sr. | 52/742.1 |

FOREIGN PATENT DOCUMENTS

| | | | |
|---|---|---|---|
| DE | 86 08 694 | U1 | 5/1986 |
| DE | 10 2010 022 661 | A1 | 12/2011 |
| DE | 10 2012 223 992 | B3 | 3/2014 |

* cited by examiner

*Primary Examiner* — Tara M. Pinnock
(74) *Attorney, Agent, or Firm* — Muncy, Geissler, Olds & Lowe, P.C.

(57) ABSTRACT

A device for compaction is provided that includes a compaction tool and a vibration device. The compaction tool is adapted to be lowered vertically into a soil area to be compacted. The vibration device being configured to be placed at an upper end on the compaction tool. The compaction tool being moveable only in the vertical direction by the vibration device. The compaction tool at its bottom end has a tool head on which at least one ripping tool is arranged, which is pivotable around a horizontal pivot axis into a first position and into a second position. In the first position, the at least one ripping tool is oriented substantially parallel to the compaction tool and in the second position is oriented substantially radially to the compaction tool and radially projects beyond a diameter of the tool head.

12 Claims, 10 Drawing Sheets

DEVICE AND METHOD FOR SOIL COMPACTION AND/OR SOIL STABILIZATION

This nonprovisional application claims priority to U.S. Provisional Application No. 61/739,734, which was filed on Dec. 20, 2012, and is herein incorporated by reference.

BACKGROUND OF THE INVENTION

1. Field of the Invention

The invention relates to a device for soil compaction and/or soil stabilization according to the features of the preamble of claim 1 and a method for soil compaction and/or soil stabilization according to the features of the preamble of claim 5.

2. Background of the Invention

Vibro compaction and vibro replacement for soil compaction are known from the conventional art. In vibro compaction, a torpedo-shaped, electric deep vibrator, vibrating in the horizontal plane, is used, which can be lengthened according to the compaction depth by extension tubes. To generate the horizontal vibrations of the vibrator, an electric motor and an unbalanced mass powered by it are located within the torpedo-shaped vibrator. Water is conveyed as a jetting aid to the vibrator tip for sinking the vibrator. In the subsequent compaction process, the inflow amount is reduced and on the surface loose soil material is poured into the forming compaction cone.

Vibro replacement is used in cohesive, also water-saturated soils. In this method, crushed stones are directed to the vibrator tip of the deep vibrator via a storage container, which can be supplied with compressed air. The compressed air is used as a jetting aid for the crushed stones. The storage container with the filling and locking system is called a sluice. Coarse-grained backfill comprising rubble, slag, or overburden are other areas of application for the vibro replacement method.

A method and a device for soil compaction are described in DE 10 2010 022 661 A1, whose entire contents are incorporated herewith by reference. In the method, a column-shaped compaction tool is lowered vertically into a soil area to be compacted and vibrations are generated by means of a vibration device in the compaction tool, in order to compact the soil area. Vertical vibration movements of the compaction tool are generated by the vibration device, which is placed on a top end of the compaction tool. The compaction tool is lowered to a predetermined target sinking depth by its self-weight and by the vibration movements, thereafter lifted at least once by a predetermined lifting height and due to its self-weight and the vibration movements again lowered repeatedly until a predetermined resistance acts against the renewed lowering.

SUMMARY OF THE INVENTION

It is therefore an object of the present invention to provide an improved device and an improved method for soil compaction and/or soil stabilization.

In an embodiment, a device is provided for soil compaction and/or soil stabilization of sand and gravel comprises a column-shaped compaction tool and a vibration device, whereby the compaction tool is to be lowered vertically into a soil area to be compacted, which is to be compacted by vibrations of the compaction tool, whereby the compaction tool is substantially closed at least at one bottom end to be lowered into the soil area and the vibration device can be placed at an upper end on the compaction tool, whereby the compaction tool can be moved preferably only in the vertical direction by the vibration device.

According to an embodiment of the invention, the compaction tool at its bottom end has a tool head, on which at least one ripping tool is disposed. Said at least one ripping tool is pivotable around a horizontal pivot axis into a first position and into a second position. In the first position, the at least one ripping tool is oriented substantially parallel to the compaction tool; i.e., it is pivoted upward and folded on the compaction tool, so that an end, facing away from the pivot axis, of the at least one ripping tool is positioned above the pivot axis and near the compaction tool. The at least one ripping tool is thereby positioned in such a way that it does not radially project beyond the diameter of the tool head, i.e., does not jut out laterally beyond the tool head. The concept of the substantially parallel orientation of the at least one ripping tool relative to the compaction tool in this first position is thereby taken to mean that the at least one ripping tool in the first position is oriented at an acute angle of preferably a maximum of 45° to the compaction tool, whereby this angle is opened at the top; i.e., the at least one ripping tool is folded upward on the compaction tool. In the second position, the at least one ripping tool is oriented substantially radially to the compaction tool and radially projects beyond a diameter of the tool head; i.e., it juts out laterally beyond the tool head.

In a method of the invention for soil compaction and/or soil stabilization of sand and gravel by means of a device, a column-shaped compaction tool is lowered vertically into a soil area to be compacted and vibrations are generated in the compaction tool by means of a vibration device in order to compact the soil area, whereby preferably solely vertical vibration movements, of the compaction tool are generated by the vibration device, which is placed on a top end of the compaction tool, whereby the compaction tool is lowered by a lowering force and by the vibration movements to a predetermined target sinking depth and is then lifted at least once by a predetermined lifting height and again lowered by the lowering force and the vibration movements until a predetermined resistance acts against the renewed lowering. The compaction tool at its bottom end has a tool head, on which at least one ripping tool is disposed, which is pivoted by the lowering of the compaction tool into a first position, in which it is oriented substantially parallel to the compaction tool, and is pivoted by the lifting of the compaction tool into a second position, in which it is oriented substantially radially to the compaction tool and radially projects beyond a diameter of the tool head, whereby by means of the at least one ripping tool during the lifting of the compaction tool a column channel wall is broken up and soil material is loosened from the column channel wall.

In the first position, the at least one ripping tool is oriented substantially parallel to the compaction tool; i.e., it is pivoted upward and folded on the compaction tool, so that an end, facing away from the pivot axis, of the at least one ripping tool is positioned above the pivot axis and near the compaction tool. The at least one ripping tool is thereby positioned in such a way that it does not radially project beyond the diameter of the tool head, i.e., does not jut out laterally beyond the tool head. The concept of the substantially parallel orientation of the at least one ripping tool relative to the compaction tool in this first position is thereby taken to mean that the at least one ripping tool in the first position is oriented at an acute angle of preferably a maximum of 45° to the compaction tool, whereby this angle is opened at the top; i.e., the at least one ripping tool is folded upward on the compaction tool. In this way, the lowering of the compaction tool and the soil compaction by means of the compaction tool are not hampered by the at least one ripping tool, because it is folded onto the compaction tool and shielded by the tool head. The column channel wall as well is not damaged during the lowering by the at least one ripping tool pivoted into the first position. In the second position, the at least one ripping tool is oriented substantially radially to the compaction tool and radially projects beyond a diameter of the tool head; i.e., it juts out laterally beyond the tool head. As a result, during the lifting of the compaction tool the column channel wall is broken up by the at least one ripping tool, which projects beyond the tool head radially, so that soil material is loosened from the column channel wall and falls under the tool head in the column channel. This soil material loosened from the column channel wall is then compacted in a subsequent lowering process of the compaction tool.

No drive unit on the device is necessary to pivot the at least one ripping tool from the first position to the second position and from the second position back to the first position, but the at least one ripping tool pivots solely by the particular force effect during the lifting or lowering of the compaction tool. During the lowering of the compaction tool, the ripping tool in the second position, i.e., folded, contacts the column channel wall. Therefore, an upwardly directed force acts on the ripping tool due to the lowering of the compaction tool. Because the pivoting movement to the first position is not blocked, the ripping tool therefore pivots upward into the first position in which it lies against the compaction tool. It is then oriented substantially parallel to the compaction tool. As a result, the ripping tool no longer projects beyond the tool head laterally, so that compaction of the soil by the ripping tool is not hampered.

During the lifting of the compaction tool, the at least one ripping tool bites into the column channel wall, as a result of which because of the lifting of the compaction tool a force effect downward on the ripping tool occurs. Because the pivoting from the first position to the second position is not blocked, the ripping tool-therefore pivots downward; it folds until it reaches the second position and lies against, for example, a stop. It is now oriented radially to the compaction tool, bites into the column channel wall during the lifting of the compaction tool, breaks this up and thereby loosens the soil material from the column channel wall, which falls downward and is to be compacted by the compaction tool during the subsequent lowering thereof.

This breaking up of the column channel wall by the at least one ripping tool is especially important, because the column channel wall is also stabilized by the lowering of the compaction tool, so that without such a mechanical breaking up of the column channel wall and loosening of the soil material insufficient soil material would detach itself from the column channel wall. Enough soil material would then not be available for sufficient compaction. A very high soil compaction is thereby achieved by the breaking up of the column channel wall by the at least one ripping tool.

Different variants of the ripping tool are expediently available, which differ particularly in their length. A soil-dependent selection of the ripping tool is possible in this way. The ripping tool is expediently attached interchangeably to the tool head, so that one variant of the ripping tool can be replaced by another variant in a simple manner, for example, by a shorter or longer variant, according to the actual soil conditions.

In this case, depending on the length of the ripping tool, more or less soil is loosened from the column channel wall and falls into the space below the compaction tool. Therefore, how much soil material is loosened and falls into the compaction zone also depends on the length of the ripping tool. Operation of the tool head without ripping tools is also possible.

Alternatively or in addition, different variants of the tool head are expediently available, which have especially different diameters. The tool head can also be selected in this way according to the actual soil conditions and/or according to a particular groundwater level.

Acting against a predetermined resistance during the repeated lowering is to be taken to mean that a predetermined lowering rate is fallen short of or that a minimum value of a lowering path is no longer achieved within a predetermined time interval.

The vibration movements are generated by a vibration device, which brings about rhythmic vertical movements in the compaction tool. In particular customary attachments, for example, vibrators, oscillators, or rammers, for example, also impact hammers can be used as the vibration device. In this case, particularly during use of rammers, a ramming movement or a ramming action or ramming impacts on the compaction tool are also to be understood as a vibration or vibration movement.

This method, which can be carried out by the device of the invention, is a full displacement technique for subsoil improvement. A bulk density of an existing foundation soil is significantly increased as a result. In this case, in contrast to the full and partial displacement technique known from the state of the art, preferably no crushed stone material is introduced into a column channel forming during the method.

The foundation soil improvement can be achieved solely by a redistribution and compaction of the existing foundation soil. To this end, the compaction tool is lowered with the ripping tool disposed in the first position, i.e., folded upwards, into the soil to be compacted, whereby the soil is compacted by the lowering of the compaction tool and by the vibration movements. Next, the compaction tool is lifted again, whereby the at least one ripping tool is pivoted by the lifting of the compaction tool into the second position, in which it is oriented substantially radially to the compaction tool and radially projects beyond the diameter of the tool head. A column channel wall is broken up in this way by means of the ripping tool during the lifting of the compaction tool, so that the soil material is loosened from the column channel wall and can be compacted in a subsequent lowering of the compaction tool, again with the ripping tool pivoted into the first position. During the lowering of the compaction tool, the at least one ripping tool is oriented in the first position and thereby substantially parallel to the compaction tool, whereby it does not project beyond the diameter of the tool head, but is disposed behind the tool head and shielded by it, so that the soil compaction is not negatively influenced by the ripping tool.

A compacted column channel, i.e., a foundation soil column, is created in this way by the repeated lowering and lifting of the compaction tool; as a linear support member the column improves the foundation soil in the vicinity of the column channel. In the case of such compaction points created close to one another by the method, i.e., in a plurality of such foundation soil columns, for example, linear or in a sheet-like grid, and, for example, at a distance of one meter to one another, complete homogenization of the soil with a considerably increased density and higher shear strength and stiffness results.

Depending on the bulk density of the soil to be compacted and to be stabilized, it may be necessary to introduce soil material, for example, sand, into the column channel, so that subsidence at the surface is not too great; therefore too large depression cones do not form. Soil material is used expediently which corresponds to the soil material of the area to be compacted. The addition can occur at different times during the process. Thus, for example, when the compaction tool is set on the compaction point on the surface, a portion of the soil material is heaped up around the compaction tool. The compaction tool then takes along the soil material into the column channel. Alternatively or in addition, soil material can be filled into the column channel, when the compaction tool has reached the target sinking depth or the particular depth point during the lowering. Alternatively or in addition, soil material can also be filled up during the compaction, i.e., during the lowering of the compaction tool.

The addition of the soil material can be combined with the addition of at least one fluid medium, for example, water or a hydraulic binder, either via the compaction tool or directly from above into the column channel, for example, by means of a hose.

Because the compacted foundation soil columns of soil material, as produced by the method and the device, are full displacement columns, the method and the device are to be used preferably in water-saturated, loose to medium dense packed sand and gravel with minor fine-grained fractions. If the particular soil is suitable but a particular water supply is too low, preferably water is added into the compaction zone. This can occur under pressure or without pressure.

The method and the device bring about the homogenization and compaction of sand and/or gravel. If the compaction of the soil alone is not sufficient or if a particular foundation soil stratification is required, expediently at least one hydraulic binder or binder mixture or at least one binder suspension is added, in order to achieve thereby a stabilization of the soil in the column channel. The load capacity of columns produced in this way is then much higher than in the case when only the soil is compacted. If bentonite or cement-bentonite or other mixtures with bentonite are used as aggregate, columns with a very low permeability are achieved with the method. Such a binder suspension is added expediently with pressure via outlet openings in the compaction tool.

For this purpose, in an advantageous embodiment the compaction tool has at least one outlet opening for at least one fluid medium. In the method when this is necessary or advantageous, preferably at least one fluid medium can be introduced in this way into a column channel and/or into a soil area adjacent to the column channel. The term fluid medium is to be taken to mean gaseous substances, liquid substances, and suspensions, i.e., as well as liquids with solids contained therein. The at least one fluid medium is, for example, water, air, or another gas or gas mixture, a hydraulic binder, for example, bentonite or a bentonite-cement suspension or cement, limestone, or mixtures of these substances. The supplying of a plurality of these substances or mixtures of these substances, i.e., a plurality of fluid media, is also possible simultaneously or sequentially during the process. The introduction into the column channel and/or into the soil area adjacent thereto can occur under pressure or without pressure. The introduction during the process is also possible at times under pressure and at times without pressure. Moreover, different fluid media can also be introduced simultaneously or sequentially, whereby one or more media can be introduced under pressure and one or more additional media without pressure. The introduction of the at least one fluid medium can occur on the soil surface via the compaction tool and/or directly via the opening in the column channel. The at least one fluid medium is expediently introduced under pressure via the compaction tool. The at least one medium is expediently introduced without pressure directly via the opening of the column channel on the soil surface.

The soil becomes additionally stabilized and/or impermeable by the introduction of at least one fluid medium formed as a binder. To improve the compaction process, it can be useful or necessary to fill water as the fluid medium into the column channel. This can occur under pressure or without pressure. Alternatively or in addition, to improve the compaction process it can be useful or necessary to inject compressed air as the fluid medium into the column channel and/or an adjacent soil area.

To improve the load capacity of the particular foundation soil columns or for other construction purposes such as changing the soil permeability, mixtures of hydraulic binders can be filled into the column channel as the fluid medium. Hydraulic binders can be, e.g., cement, limestone, bentonite, and a mixture of these products, for example, limestone-cement and cement bentonite. The suspensions are prepared in separate equipment units. The addition can occur under pressure or without pressure.

The at least one outlet opening on the compaction tool for supplying the at least one fluid medium is, for example, disposed on the tool head or on the columnar base body. Expediently, the compaction tool has a plurality of outlet openings, which are disposed on the tool head and/or on the columnar base body. The one or more outlet openings can be arranged on the tool head, for example, above the ripping tools, between the ripping tools, and/or below the ripping tools. They can be arranged, for example, also in the frustoconical active surface of the tool head, for example, in the cone lateral surface and/or in the top surface. If the compaction tool has one or more such outlet openings, then the concept of the substantially closed bottom end of the compaction tool and/or the substantially closed frustoconical active surface means that the bottom end of the compaction tool and/or the frustoconical active surface are completely closed with the exception of the at least one outlet opening or the plurality of outlet openings. This at least one outlet opening or the plurality of outlet openings is to be closed and opened expediently in each case by means of a valve, so that the bottom end of the compaction tool and/or the frustoconical active surface are completely closed in the case of closed valves. The valves are formed, for example, as ball valves.

To supply the at least one fluid medium to the at least one outlet opening or to the plurality of outlet openings, expediently one or more feed lines from the outlet opening or the outlet openings are placed upwards on the outside of the compaction tool or advantageously in the hollow compaction tool. If the feed lines are disposed in the compaction tool, the columnar base body expediently in the top end region has a side outlet opening through which the feed lines can be brought outwards.

In a plurality of outlet openings, each outlet opening can be provided for a special fluid medium or the outlet openings can be used, for example, to supply a plurality of fluid media to the column channel and/or to the adjacent soil area, for example, both the supplying of water and the supplying of a hydraulic binder.

Alternatively or in addition, the compaction tool may have at least one so-called vacuum lance, i.e., a tube disposed on the compaction tool, which is coupled to a suction unit. A negative pressure is to be produced in this way in the column channel. Pressure relief in the groundwater is to be achieved thereby in the soil area to be compacted.

In particular conventional attachments, for example, vibrators, oscillators, or rammers, can be used as a vibration device, which brings about rhythmic vertical movements in the compaction tool. These can be operated in their respective frequency range to carry out the method. The method can be carried out with vibration frequencies from a very broad frequency range, so that in this regard there are no limitations with respect to the vibration devices to be used and their specific vibration frequency. In this case, particularly with the use of rammers, a ramming movement or a ramming action or ramming impacts on the compaction tool are also to be understood as a vibration or vibration movement. An oscillator, recessed in an interior of the compaction tool, in the form of a motor and unbalanced mass driven by it, which, as is known from the state of the art, produces horizontal vibrations, is not used.

An extremely high driving energy of the vibration device set on the compaction tool, for example, an oscillator attachment, through the full displacement process has the effect that the soil material, for example, the gravel, is forced, rammed, and pressed laterally into a soil matrix and thereby compaction and compression of the soil and a reduction of a pore fraction is brought about. In vibratory rammers, part of the energy is also transformed into horizontal vibrations, so that the compaction tool spreads out the compaction energy very broadly in the foundation soil, so that the compaction effect occurs not only in the column channel of the compaction tool, but also in a vicinity that is the multiple of the diameter of the compaction tool.

The lowering force, which is used in addition to the vibration movements to lower the compaction tool and to compact the soil in the column channel, is generated by the self-weight of the column-shaped compaction tool and the vibration device. Preferably, a force effect by a holding device on the compaction tool occurs in addition. To this end, so-called piling rigs are used. In this way, the lowering force is made up of the self-weight of the column-shaped compaction tool and the vibration device as well as this additional force effect from the holding device. The compaction tool is connected in this case via a mount, which is also called a sledge, and a so-called leader with the holding device, for example, with an excavator or crane. The leader is disposed as at least one guide and/or support rail on the holding device. The mount is disposed movable on the leader. The compaction tool disposed on the mount is to be lifted and lowered by means of the holding device; i.e., it is disposed vertically movable on the holding device. In this case, the mount is expediently connected to a drive of the holding device by which drive it and thereby the compaction tool are to be lifted and especially also to be lowered under power. I.e., the mount formed as a sledge and with it the compaction tool, guided by the leader, on which the mount is disposed movably, are to be lifted by means of the drive of the holding device and also to be lowered under power. In this way, a force effect is to be transferred to the mount and via the mount to the compaction tool by the holding device drive, i.e., for example, by a suitable lowering drive of the excavator or crane. I.e., the compaction tool can be lowered by means of the drive of the holding device and is lowered during the process in such a way that a force acts on the compaction tool in the lowering direction at least at times via the holding device drive during the lowering. This force acts vertically downward on the compaction tool.

In the extreme case, in this way part of the self-weight of the holding device acts together with the self-weight of the compaction tool and the vibration device on the soil to be compacted. This can have the result that during the lowering of the compaction tool the holding device is lifted at least partially from the ground.

The compaction of the soil by means of the compaction tool occurs in this way not only by means of the vibrations of the vibration device, but in addition also by means of a high compressive force, namely, by the lowering force, with which the compaction tool is lowered. This additional compressive force, i.e., the lowering force with which the compaction tool is lowered, can be, for example, up to 20 tonnes or also up to 30 tonnes. The soil compaction occurs in this way by means of the device and the method by full displacement, by the vibration movements, and the resulting vibration pressure, as well as by the additional high compressive force which results in a corresponding lowering pressure.

The area of application of, for example, holding devices formed as a supporting caterpillar with leaders is limited. For this reason, in the case of compaction depths to be achieved of over 20 m, for example, at compaction depths of up to 25 m, 30 m, or 40 m, the tool head is mounted on a very long driven tube, so that accordingly a very long compaction tool is formed. The vibration device is mounted at the top on the compaction tool, i.e., on the upper end of the driven tube. In this variant of the device for soil compaction and soil stabilization, the lowering force includes the self-weight of the column-shaped compaction tool, which comprises the driven tube, and the self-weight of the vibration device. The compaction tool, which comprises the driven tube, and the vibration device in this case hang on a cable. For example, a cable excavator is used as the holding device, which is also called supporting device. As soon as the compaction tool is placed on the ground, the vibration device is started, so that the compaction tool is driven into the ground up to the target sinking depth by the lowering pressure, formed by the self-weight of the compaction tool and the vibration device, and by the vibration pressure due to the action of the vibration device, i.e., by its vibrations, oscillations, and/or hammering by lowering of the cable, lifted again, and then lowered and lifted again so often until the soil is compacted up to the surface or close to the surface. In so doing, the compaction tool because of the very long driven tube has a very high self-weight, so that the lowering force corresponds, for example, to the lowering force achievable with the leader device.

Expediently, the tool head of the compaction tool has a substantially closed frustoconical active surface. The tool head is preferably made of solid steel. The shape of the tool head is, for example, a truncated cone with an angle of a cone lateral surface to a cone base of about 45°. A columnar base body of the compaction tool can be made, for example, of solid material, i.e., as a rod or, to reach a greater sinking depth, a plurality of connected rods. Preferably, this base body is made of a hollow tube, however, or to reach a greater sinking depth of a plurality of connected hollow tubes.

For example, so-called driven tubes, which form a base body of a compaction tool according to the state of the art, can be used as such tubes. The bottom end of the tubes or, in the case of a plurality of tubes, of the last tube is to be closed by the tool head, for example, by welding or screwing on of the tool head or by forming the tool head and tubes as a single piece. In so doing, screwing on is to be preferred, because in this way the compaction tool can be easily assembled, disassembled, and transported. Furthermore, the tool head can be easily replaced, for example, in the event of signs of wear and the compaction tool can be adapted very rapidly and easily to the specific circumstances and requirements, for example, to particular soil conditions by a replacement of the tool head.

This applies similarly also to the embodiment of the columnar base body of the compaction tool made of solid material, i.e., as a rod. Here as well, for example, the rod and the tool head are made as a single piece or the tool head is welded or preferably screwed together with the rod, with the described advantages.

When hollow tubes, for example, driven tubes, are used as the columnar base body of the compaction tool, lines for supplying water, suspension, and/or air to the tube interior can be run. If rods or other profiles are used, for example, H-profiles, then when supplying of water, suspension, and/or air to the tool head is necessary, these lines must be disposed on the outside on the columnar base body.

Because of the frustoconical active surface of the tool head and the vertical vibration movement of the compaction tool and expediently because of the above-described additional compressive force on the compaction tool, a predominantly vertical force transmission occurs in the column channels, so that extremely rigid foundation soil columns can be produced which have comparable properties as foundation soil columns produced by means of methods and devices according to the state of the art.

Furthermore, part of the force transmission occurs via a lateral surface of the frustoconical active surface of the tool head in side areas of the column channel. I.e., a lateral expansion of the compaction energy and thereby an increased radial expansion of foundation soil columns produced by the compaction tool are achieved.

In order not to hamper the compaction effect of the active surface of the tool head by the at least one ripping tool, the at least one ripping tool is disposed above the active surface on the tool head, so that in the state pivoted into the first position it is shielded by the active surface.

Preferably, a plurality of ripping tools, which can be pivoted into the first position and into the second position in the above-described manner and in the second position are oriented substantially radially to the compaction tool and radially project beyond the diameter of the tool head, i.e., project laterally beyond the active surface of the tool head, are disposed on the tool head uniformly distributed over its circumference. In this way, a uniform breaking up of the column channel wall during lifting of the compaction tool is achieved, so that an effective loosening of the soil material from the column channel wall is achieved, which is compacted by the subsequent lowering of the compaction tool. For example, two, three, four, five, six, seven, eight, nine, ten, or more ripping tools can be arranged on the tool head uniformly distributed over its circumference. The number of ripping tools can depend, for example, on a specific diameter of the tool head and/or on a soil to be compacted by the compaction tool.

In the method, expediently the lifting of the compaction tool by the predetermined lifting height and subsequent lowering are repeated alternatingly so often until the predetermined resistance acts against the lowering, when the compaction tool is located at a predetermined end position. I.e., a recurring lifting occurs, which can be carried out with or without vibration movements, therefore with a vibration device that is turned on or off, as well as a subsequent lowering with a turned-on vibration device with compaction of the soil.

Particularly during the lifting of the compaction tool, which can be carried out with a turned-on or turned-off vibration device, by the action of the at least one ripping tool pivoted into the second position, soil material breaks out of the side column channel wall and falls under the tool head into a hollow space of the column channel not yet filled with soil material, so that it is to be compacted during the subsequent repeated lowering of the compaction tool. As a result, the compaction tool can no longer be lowered to the original target sinking depth, but because of the compaction of additional soil material, the previously predetermined resistance works against the compaction tool so that it is again lifted by the predetermined lifting height and then again lowered.

A steady buildup of material with the compacted soil material occurs in the hollow space of the column channel formed by the compaction tool by means of such an oscillating up-and-down movement, so that the hollow space of the column channel is filled stepwise in the direction of a soil surface with extremely compacted soil material and the extremely compacted, filled column channel, i.e., the extremely compacted foundation soil columns, forms as a result.

In order to promote the breaking out of the soil material from the side column channel wall, preferably after the lifting of the compaction tool by the predetermined lifting height and before the subsequent lowering of the compaction tool, there is a pause for a predetermined time period, for example, a few seconds, in the lifted position in the case of an activated vibration device, so that soil material can collapse and come under the tool head.

A vertical lowering pressure due to the lowering force during the lowering of the compaction tool and an additionally acting vertical vibration pressure, generated by the vibration device, are transmitted vertically by the flattened conical tip of the tool head, i.e., by the frustoconical active surface of the tool head, and at the slanting tool head surfaces of the cone lateral surface by the force couples formed there with horizontal and vertical force direction components both vertically and horizontally into the foundation soil, i.e., into the soil to be compacted. In this way, the soil compaction occurs both under the compaction tool and also to the side of the compaction tool, so that the column channel filled with compacted soil material, i.e., the compacted foundation soil column, has a larger diameter than the compaction tool or its tool head.

Vibration devices are normally used whose frequency can be controlled, so that the frequency with the greatest compaction effect can be selected specific for the foundation soil.

Due to this method and the device for carrying out the method, a so-called displacement wave occurs in the foundation soil, whereby because the foundation soil columns are produced with a mounted vibration device, this begins already at the ground surface. In this case, due to the compaction of the soil material and the slipping and compaction of this slipped soil material as well, depending on the bulk density of the soil a crater formation in the area of the ground surface above the soil compression can result.

When necessary, this depression cone forming due to the soil compaction on the ground surface above the soil compaction is filled expediently during and/or after the soil compaction carried out by the compaction tool with a compactible material, for example, with a readily compactible mineral such as gravel in mixed round grain form or mixed crushed grain form. This occurs preferably without delay during the process, so that a too large depression cone, hollow spaces, and too great material loss do not occur at the ground surface. The material addition occurs from outside, i.e., from above into the forming depression cone.

Advantageously, the compressive force acting through the compaction tool on the soil area to be compacted, the vibration pressure generated by an employed vibration energy by means of the vibration device and acting via the compaction tool on the soil area to be compacted, and a sinking depth of the compaction tool are determined.

The lowering pressure thereby only acts to a full extent when the compaction tool is completely stopped. If the compaction tool is lifted, only a reduced pressure component due to part of the self-weight of the compaction tool still acts or this component no longer acts.

Constant monitoring of the process is enabled by this preferably continuous determination of the lowering pressure, the vibration pressure, and the sinking depth during the process, so that the compaction tool can be lifted by the predetermined lifting height when the predetermined target sinking depth is reached. Further, it can also be determined thereby when in the further soil compaction steps the predetermined resistance acts against the compaction tool, so that it no longer drops due to the pressure effect and has to be again lifted by the predetermined lifting height.

Moreover, an evaluation for quality assurance is made possible by the determination of the pressure and sinking depth. It can be evaluated thereby whether the soil compacted in this way and the foundation soil produced thereby meet the particular requirements, i.e., for example, have a sufficient bearing capacity, strength, and stability, to carry out the planned construction measures on the foundation soil, for example, to construct a structure or building thereon.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
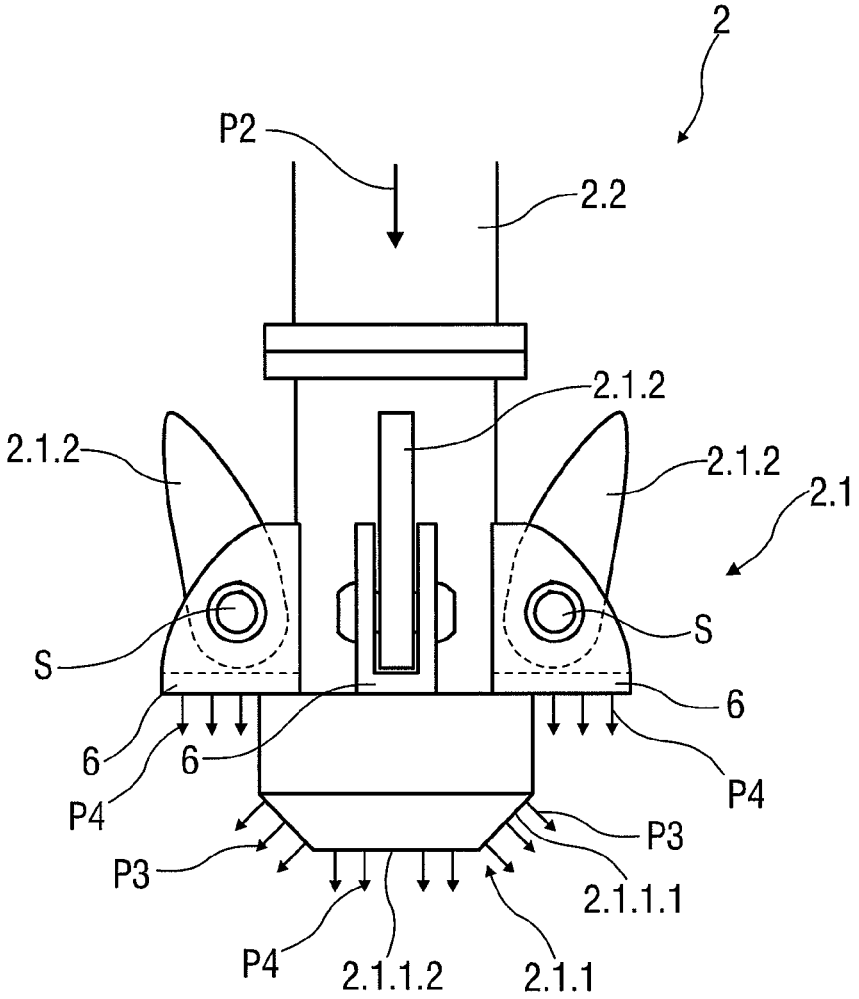
FIG. 1 shows schematically a compaction tool of a device for soil compaction and/or soil stabilization with upwardly folded ripping tools in a side view.

Parts corresponding to one another are provided with the same reference characters in all figures.

Figure 2:
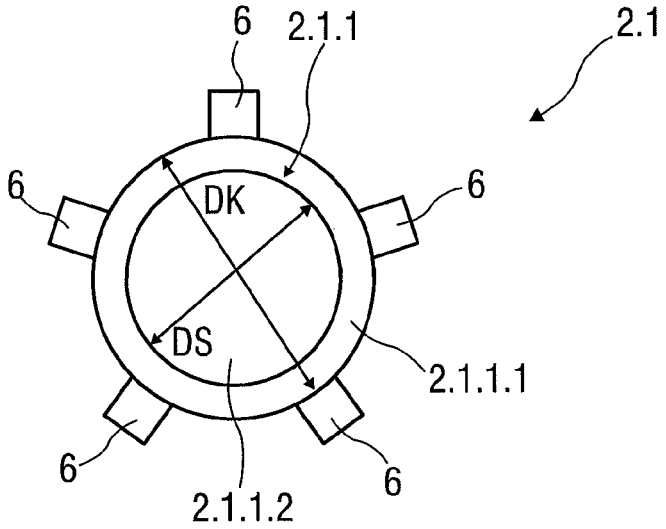
FIG. 2 shows schematically a tool head of a compaction tool of a device for soil compaction and/or soil stabilization with upwardly folded ripping tools in a plan view from below.
Figure 3:
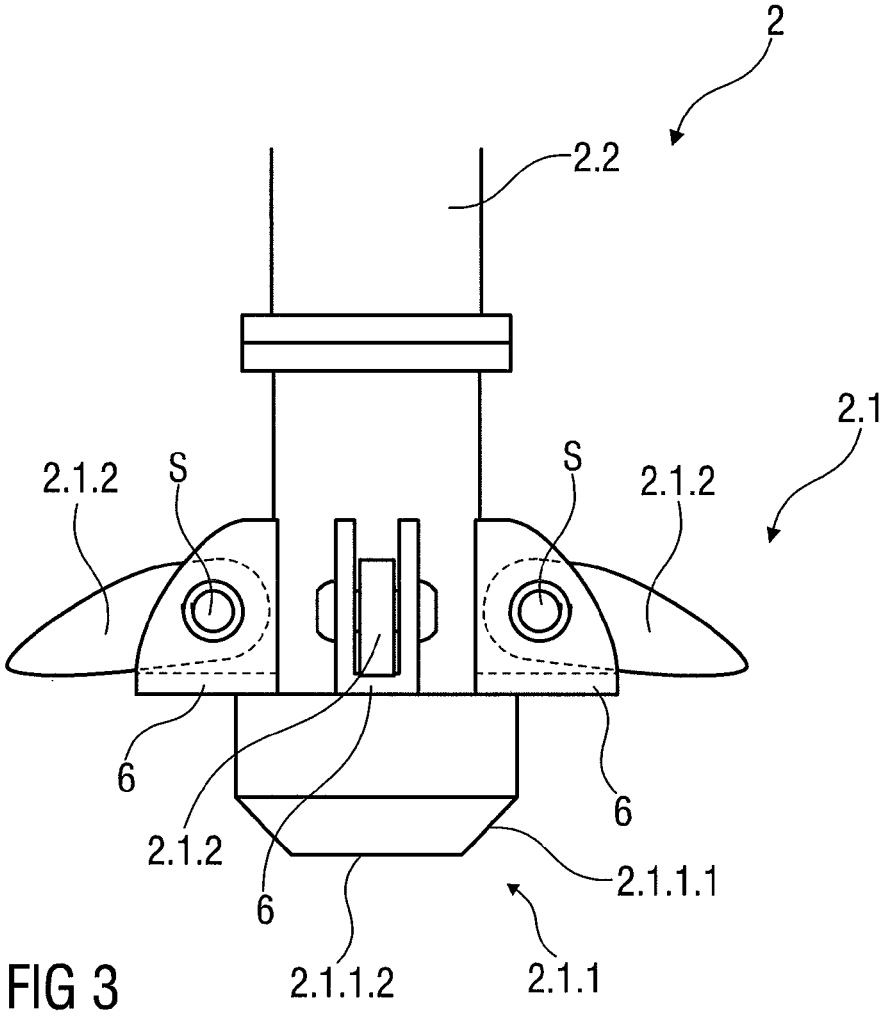
FIG. 3 shows schematically a compaction tool of a device for soil compaction and/or soil stabilization with downward folded ripping tools in a side view.
Figure 10:
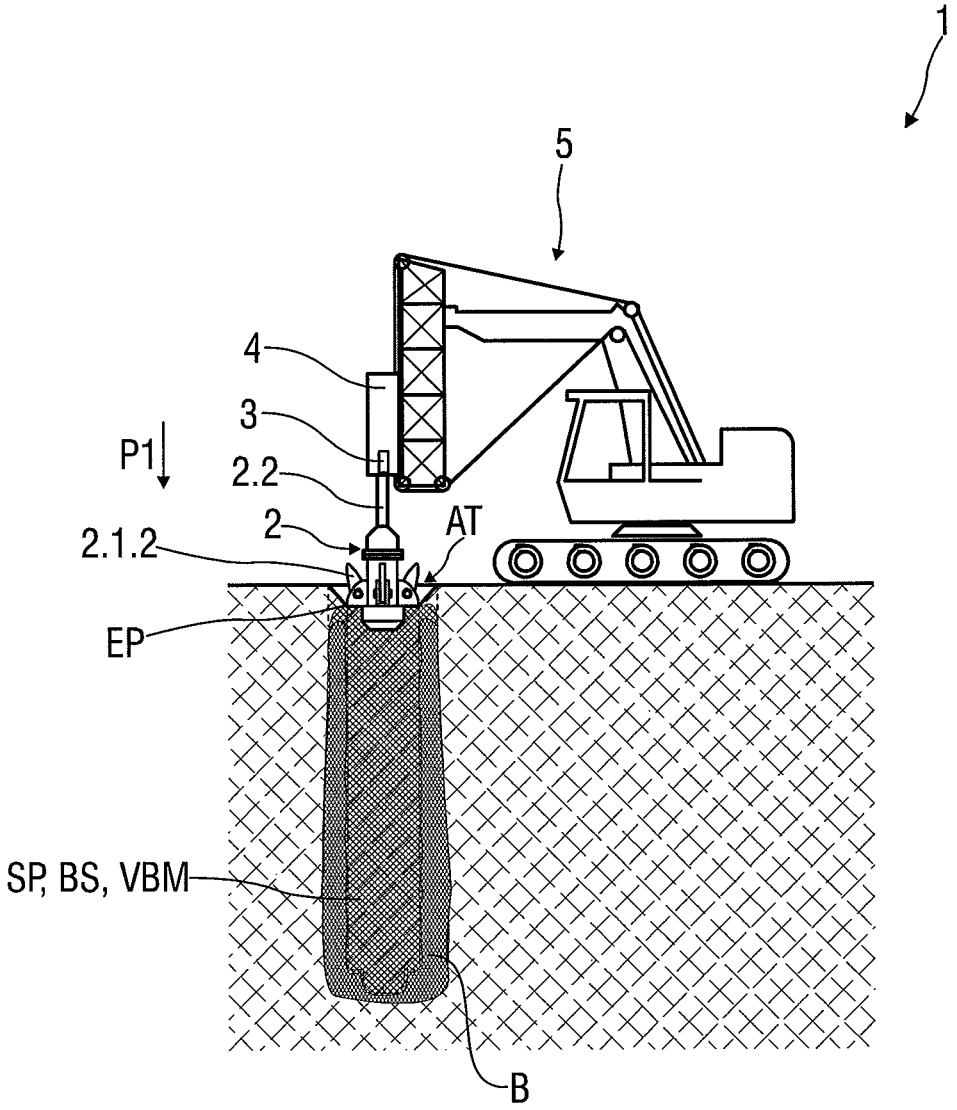
FIG. 10 shows schematically a device for soil compaction and/or soil stabilization with a compaction tool in a fifth position.
Figure 11:
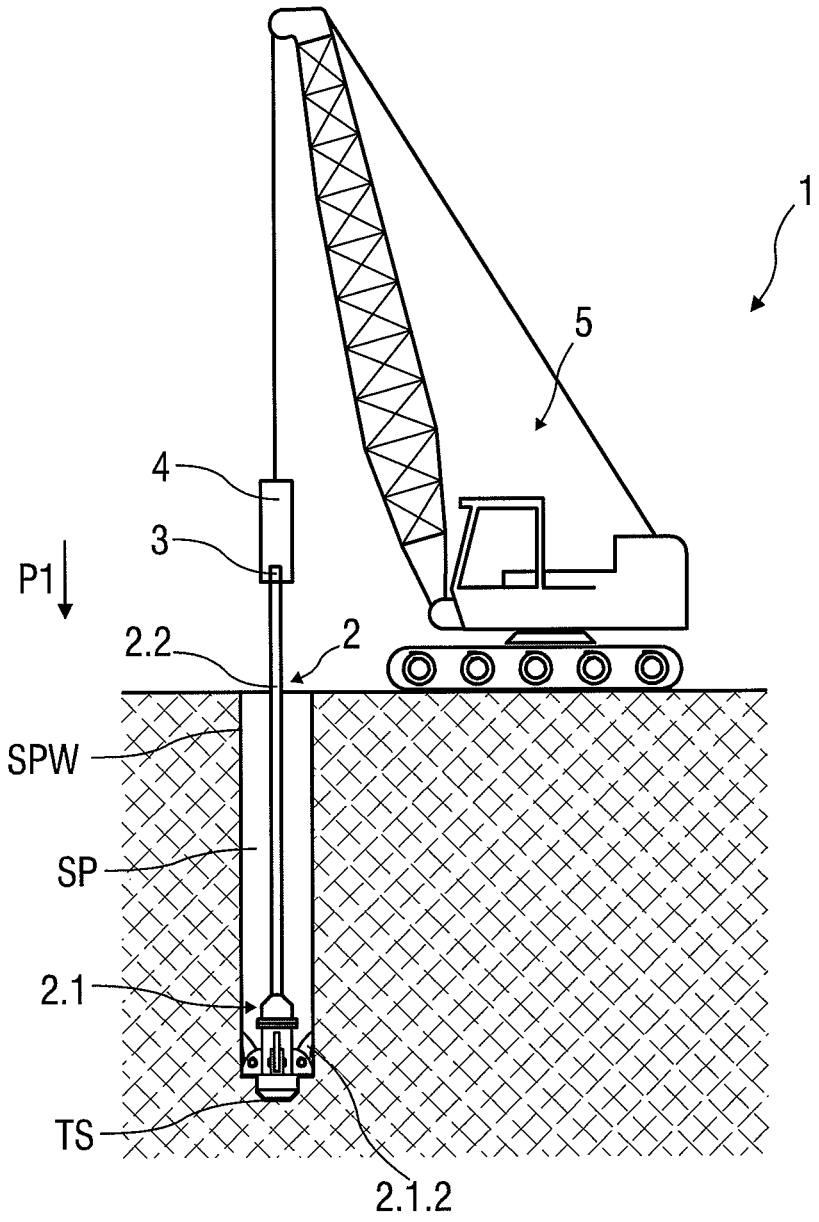
FIG. 11 shows schematically a further embodiment of a device for soil compaction and/or soil stabilization.

FIGS. 1 and 3 show a compaction tool 2 of a device 1 for soil compaction, by means of which a method for soil compaction and soil stabilization can be carried out. A method and a device 1 for soil compaction are already known from DE 10 2010 022 661 A1, whose entire contents are incorporated herewith by reference. The method described hereafter for soil compaction and/or soil stabilization and device 1 for soil compaction and/or soil stabilization, by means of which this method can be carried out, represent an improvement of the method known from DE 10 2010 022 661 A1 and device 1 known from DE 10 2010 022 661 A1. A tool head 2.1 of said compaction tool 2 is illustrated in greater detail in FIGS. 2 and 4. A further advantageous embodiment of compaction tool 2 is illustrated in FIG. 5. FIGS. 6 to 10 show device 1 for soil compaction and/or soil stabilization during an operation of the method. Device 1 has a column-shaped compaction tool 2 with tool head 2.1, for example, made of solid steel, and a columnar base body 2.2. Tool head 2.1 has a substantially closed frustoconical active surface 2.1.1. A further advantageous embodiment of device 1 is illustrated in FIG. 11.

Figure 12:
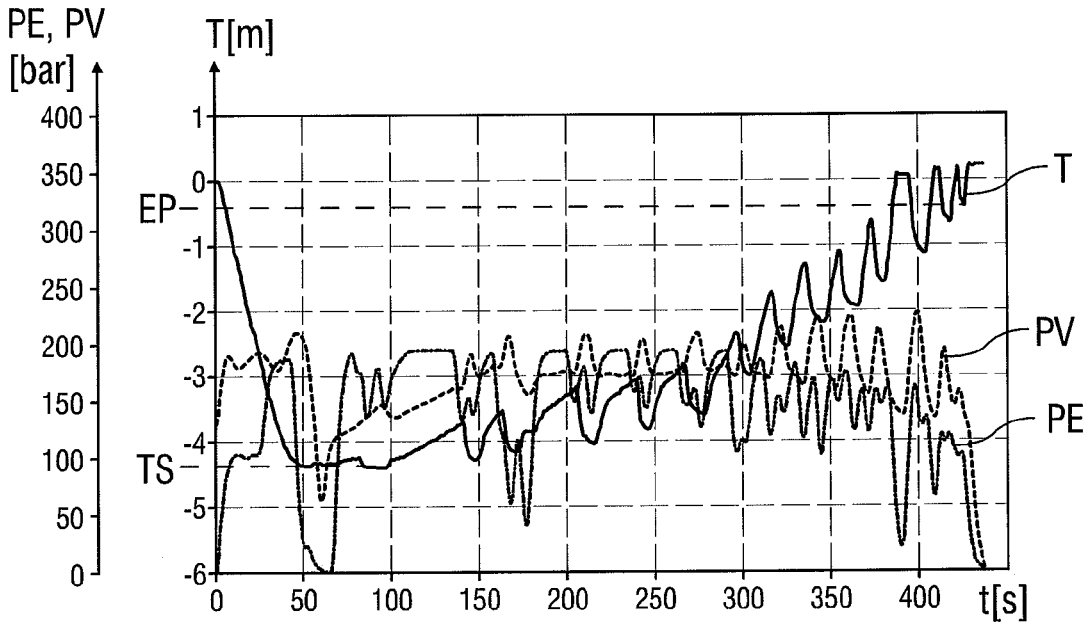
FIG. 12 shows schematically a diagram with a curve of a lowering pressure, vibration pressure, and a sinking depth during the process.

The columnar base body 2.2 of compaction tool 2 can be made, for example, of solid material, i.e., as a rod or, to achieve a greater sinking depth T, as a plurality of connected rods. In this case, with an increasingly smaller sinking depth T, the number of employed rods is reduced increasingly. Preferably, however, this base body 2.2 is made of a hollow tube or, to reach the greater sinking depth T, as illustrated in FIGS. 6 to 10, of a plurality of connected hollow tubes. In this case, with an increasingly smaller sinking depth T, the number of employed hollow tubes is reduced increasingly. Thus, to form columnar base body 2.2, to which tool head 2.1 is attached, in FIG. 10, at the end of the process, for example, still only one hollow tube is used, whereas in FIG. 6, at the beginning of the process, a plurality of hollow tubes are still needed for columnar base body 2.2, to reach an accordingly great sinking depth T at the beginning of the process. The sinking depth T of compaction tool 2 is illustrated in FIG. 12 in a time course t of the process.

For example, so-called driven tubes, which form a base body of a compaction tool according to the state of the art, can be used as such tubes. The bottom end of the tubes or, in the case of a plurality of tubes, of the last tube is to be closed by tool head 2.1, for example, by welding or screwing on of tool head 2.1 or by forming tool head 2.1 and the tubes as a single piece. I.e., the bottom end of compaction tool 2 is closed by tool head 2.1, which is disposed at the bottom end of columnar base body 2.2.

In so doing, screwing on is to be preferred, because in this way compaction tool 2 can be easily assembled, disassembled, and transported. Furthermore, tool head 2.1 can be easily replaced, for example, in the event of signs of wear and compaction tool 2 can be adapted very rapidly and easily to the specific circumstances and requirements, for example, to the particular soil conditions by replacement of tool head 2.1.

This applies analogously also to the embodiment of the columnar base body 2.2 of compaction tool 2 made of solid material, i.e., as a rod or as another profile, for example, as an H-profile or hollow box. Here as well, for example, the rod and tool head 2.1 are made as a single piece or the tool head is welded or preferably screwed together with the rod, with the described advantages.

A vibration device 3, which brings about rhythmic and solely vertical movements with a constant or controllable variable frequency, for example, between 5 Hz and 20 Hz, in compaction tool 2, is placed on a top end of compaction tool 2. Vibration device 3 can be in particular a conventional attachment device, for example, a vibrator, an oscillator, or rammer, for example, also a vibratory rammer for sheet pile wall pile driving. In this case, particularly during use of rammers, a ramming movement or a ramming action or ramming impacts on compaction tool 2 are also to be understood as a vibration or vibration movement.

Further, a mount 4 is disposed on compaction tool 2, which is connected to a holding device 5, for example, to an excavator or crane, as is shown schematically in FIGS. 6 to 10. Mount 4 is also called a sledge, which is disposed vertically movable on a leader. The leader is at least one guide and/or support rail, which is attached to holding device 5. In this case, vibration device 3 is mounted on mount 4 which is formed as a sledge and is built vertically movable onto the leader. The leader is connected rigidly to holding device 5, for example, a supporting caterpillar. Compaction tool 2 can be transported by means of holding device 5 to a site where soil compaction is to be carried out; there it can be held in a vertical position, lowered vertically into a soil to be compacted and again lifted, as is shown in FIGS. 6 to 10 by a first arrow P1 in each case, which shows the particular vertical movement direction of compaction tool 2.

Figure 4:
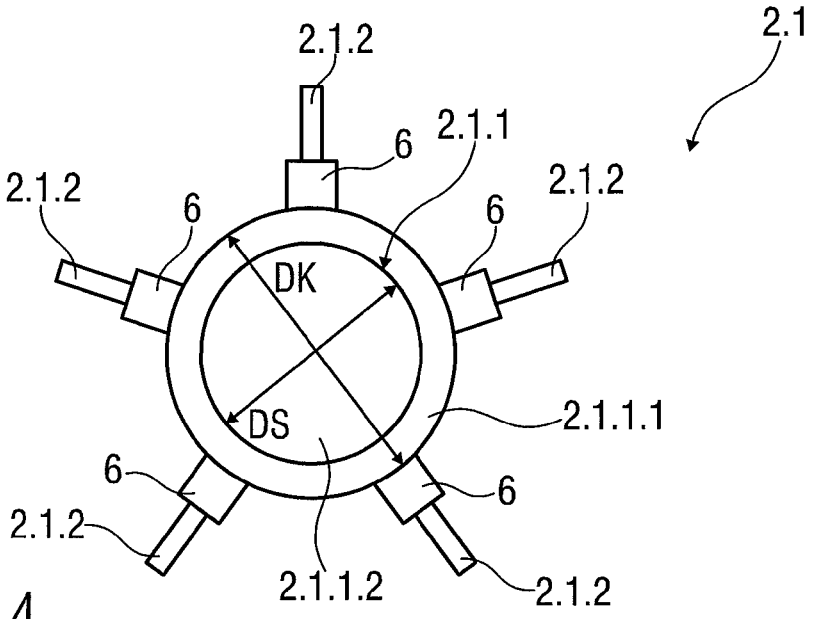
FIG. 4 shows schematically a tool head of a compaction tool of a device for soil compaction and/or soil stabilization with downward folded ripping tools in a plan view from below.
Figure 5:
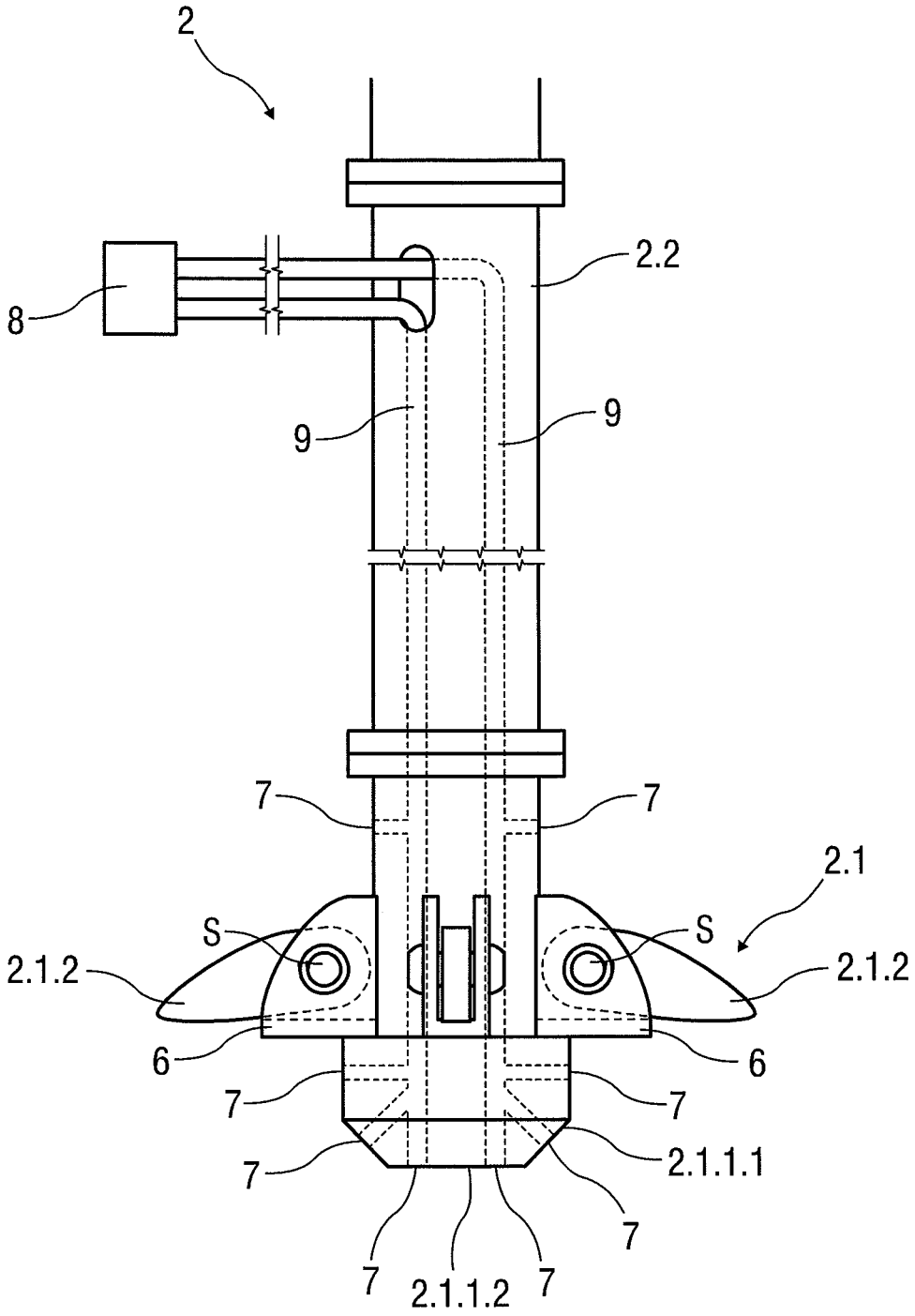
FIG. 5 shows schematically a compaction tool of a device for soil compaction and/or soil stabilization with a plurality of outlet openings in a side view.

Tool head 2.1 with its frustoconical active surface 2.1.1 is illustrated in FIGS. 1 and 3 in a side view and in FIGS. 2 and 4 in a plan view from the bottom. The frustoconical active surface 2.1.1 comprises a cone lateral surface 2.1.1.1 and a top surface 2.1.1.2. The form of tool head 2.1, i.e., a bottom active part of tool head 2.1, is, for example, a truncated cone with an angle of the cone lateral surface 2.1.1.1 to a cone base surface of about 45°. The truncated cone has its maximum cone diameter DK at the base area. This cone diameter DK of the cone base area can be, for example, between 25 cm and 70 cm. The cone base area of tool head 2.1 illustrated here has a cone diameter DK of 40 cm. Depending on the particular soil conditions, a tool head 2.1 with a cone diameter DK best suitable for the particular soil conditions is used.

A lateral expansion of a compaction energy and an increased radial expansion of the foundation soil columns BS, produced by compaction tool 2, are achieved with the frustoconical design of active surface 2.1.1 of tool head 2.1. Such a finished foundation soil column BS is illustrated in FIG. 10. A radial expansion of a displacement and compaction effect on a soil material in this case is at least twice to three times the cone diameter DK of tool head 2.1. It can also be greater, depending on the particular soil.

A splitting of the vertical force of compaction tool 2, which is illustrated by a vertical second arrow P2, is shown in FIG. 1. The vertical force is divided into a vertically acting force component and an obliquely downward acting force component. The vertical force component acts via top surface 2.1.1.2 and additionally via mounting parts 6, which are described in greater detail below and also called a bracket. This vertically acting force component is illustrated by third arrow P3. The obliquely downwardly acting force component acts via cone lateral surface 2.1.1.1, indicated by fourth arrow P4. A force transmission in the vertical direction occurs by tool head 2.1 with its frustoconical active surface 2.1.1 and additionally by mounting parts 6, called brackets, therefore during a lowering of compaction tool 2, and moreover a force transmission occurs by cone lateral surface 2.1.1.1 in the direction obliquely downward, i.e., perpendicular to the cone lateral surface 2.1.1.1, into the soil. Compaction tool 2 is moved only vertically by vibration device 3. Due to the frustoconical active surface 2.1.1, the forces generated by vibration device 3 and the lowering force due to the lowering of compaction tool 2 are divided into vertically acting forces, proceeding from top surface 2.1.1.2 of the truncated cone and mounting parts 6, and into obliquely laterally acting forces, proceeding from lateral surface 2.1.1.1 of the truncated cone. The flattened top surface 2.1.1.2 of the frustoconical active surface 2.1.1 of tool head 2.1 has a tip diameter DS of, for example, 10 cm. Depending on the particular soil conditions, a tool head 2.1 with a tip diameter DS best suitable for the particular soil conditions is used.

Tool head 2.1 illustrated here, moreover, has a plurality of ripping tools 2.1.2, which advantageously are distributed uniformly over the circumference of tool head 2.1. These ripping tools 2.1.2 are placed pivotable in each case around a horizontal pivot axis S on tool head 2.1. Ripping tools 2.1.2 are connected to mounting parts 6, which are fixedly disposed on tool head 2.1, for example, are welded to it, via the particular pivot axis S. Ripping tools 2.1.2 are disposed here above the frustoconical active surface 2.1.1 on tool head 2.1. Ripping tools 2.1.2 are disposed pivotable in such a way that they can be pivoted into a first position shown in FIGS. 1 and 2 and into a second position shown in FIGS. 3 and 4. A length of ripping tools 2.1.2 depends expediently on a particular foundation soil condition. Ripping tools 2.1.2 are preferably disposed on tool head 2.1 replaceable in a simple way, so that depending on the particular soil condition ripping tools 2.1.2 with a length best suitable for it can be used. Ripping tools 2.1.2, which are disposed in each case currently on tool head 2.1, may have lengths different from one another.

In the first position, ripping tools 2.1.2 are pivoted upward in the direction of base body 2.2 and thereby folded on compaction tool 2 or on tool head 2.1. They are oriented substantially parallel to compaction tool 2, i.e., substantially parallel to base body 2.2 of compaction tool 2. They are positioned in this first position in such a way that an end, facing away from the pivot axis S, of ripping tool(s) 2.1.2 is positioned above the particular pivot axis S and close to compaction tool 2. The concept of the substantially parallel orientation of ripping tool 2.1.2 relative to compaction tool 2 in this first position is thereby taken to mean that ripping tools 2.1.2 in the first position are oriented at an acute angle of preferably a maximum of 45° to compaction tool 2, whereby this angle is opened at the top. It is critical here that ripping tools 2.1.2 in this first position are positioned in such a way that they do not jut out laterally beyond tool head 2.1, i.e., do not project radially beyond cone diameter DK of tool head 2.1.

In the second position, ripping tools 2.1.2 are oriented substantially radial to compaction tool 2, so that they project radially beyond tool head 2.1 and thereby cone diameter DK of tool head 2.1; i.e., in this second position they project laterally beyond the frustoconical active surface 2.1.1 of tool head 2.1.

An end, facing away from the particular pivot axis S, of ripping tools 2.1.2 is formed tapered. To this end, a bottom side of ripping tools 2.1.2 is formed straight or nearly straight, so that good support on the respective mounting parts 6 in the state pivoted into the second position is assured, and a top side of ripping tools 2.1.2 is formed curved with increasing distance from the pivot axis S in the direction of the bottom side.

These ripping tools 2.1.2 are pivoted by the lowering of compaction tool 2 into the first position, in which they are oriented substantially parallel to compaction tool 2. I.e., they are folded on compaction tool 2 by the lowering of compaction tool 2. Ripping tools 2.1.2 are pivoted by the lifting of compaction tool 2 into the second position, in which they are oriented substantially radially to compaction tool 2 and radially project beyond the diameter of tool head 2.1. I.e., ripping tools 2.1.2 are folded down by the lifting of compaction tool 2, i.e., folded outward. In this way, a column channel wall SPW is broken up by means of ripping tools 2.1.2 during the lifting of compaction tool 2, so that soil material is loosened from the column channel wall SPW and can be compacted in a subsequent lowering of compaction tool 2.

No drive unit on device 1 is necessary for pivoting ripping tools 2.1.2 from the first position to the second position and from the second position back to the first position, rather ripping tools 2.1.2 pivot solely by the particular force effect during the lifting or lowering of compaction tool 2. During the lowering of compaction tool 2, ripping tools 2.1.2 in the second position, i.e., folded, contact the column channel wall SPW. Therefore, an upwardly directed force acts on ripping tools 2.1.2 by the lowering of compaction tool 2. Because the pivoting movement to the first position is not blocked, ripping tools 2.1.2 therefore pivot upward into the first position, in which they lie against compaction tool 2. They are then oriented substantially parallel to compaction tool 2. As a result, they no longer project laterally beyond tool head 2.1, so that compaction of the soil by ripping tools 2.1.2 is not hampered.

During the lifting of compaction tool 2, ripping tools 2.1.2 bite into the column channel wall SPW, as a result of which because of the lifting of compaction tool 2 a force effect downward on ripping tools 2.1.2 occurs. Because the pivoting from the first position to the second position is not blocked, ripping tools 2.1.2 therefore pivot downwards; i.e., they fold open until they lie with their bottom side on mounting parts 6, more precisely, on a bearing surface of mounting part 6. They are now oriented radially on compaction tool 2, during the lifting of compaction tool 2 bite into the column channel wall SPW, break it up, and thereby loosen soil material from the column channel wall SPW; the soil material falls downward and with a subsequent lowering of compaction tool 2 is to be compacted by said tool.

Said ripping of the column channel wall SPW by ripping tools 2.1.2 is especially important, because due to the lowering of compaction tool 2 the column channel wall SPW is also already stabilized, so that without this type of mechanical ripping of the column channel wall SPW and loosening of soil material not enough soil material would loosen from the column channel wall SPW. Enough soil material would then not be available for sufficient compaction. Therefore a very high soil compaction is achieved by the ripping of the column channel wall SPW by means of ripping tools 2.1.2. To achieve the most effective ripping of the column channel wall SPW possible, therefore preferably, as already described, a plurality of ripping tools 2.1.2 are advantageously uniformly distributed over a circumference of tool head 2.1, for example, as in the examples illustrated here, five ripping tools 2.1.2. In other exemplary embodiments, tool head 2.1 may also have more or fewer ripping tools 2.1.2, for example, three, four, or six, or seven, or more ripping tools 2.1.2.

Figure 6:
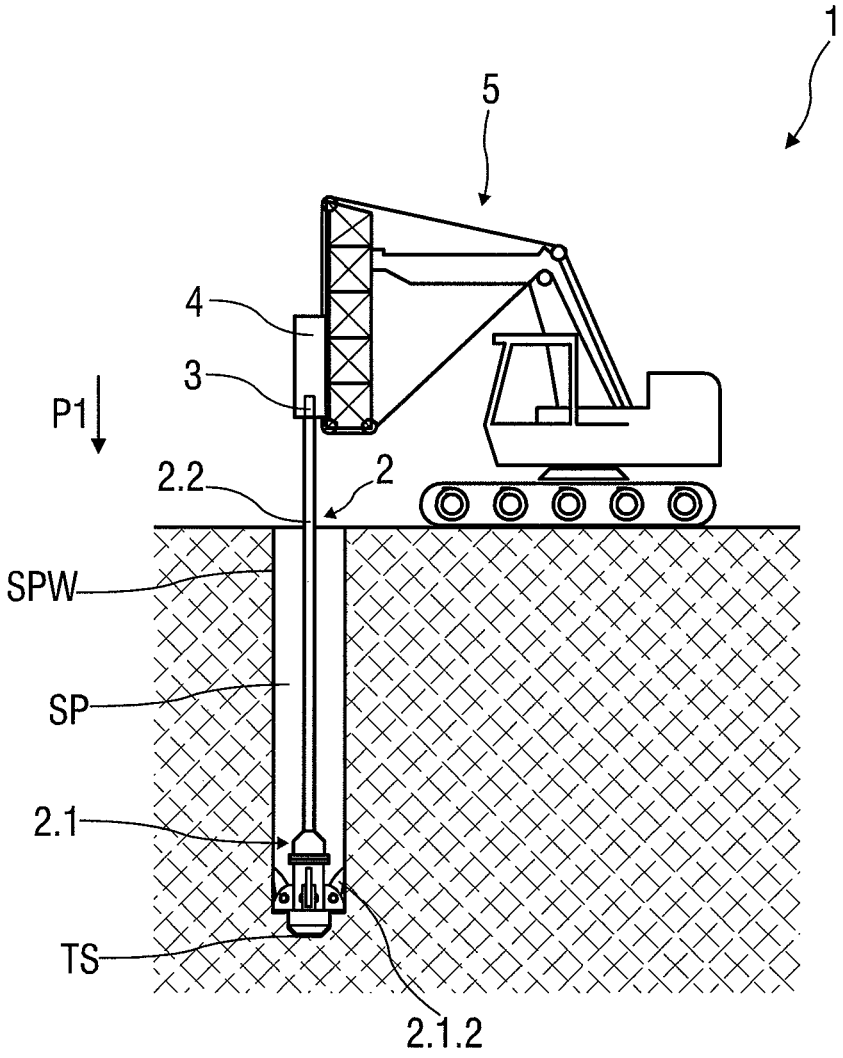
FIG. 6 shows schematically a device for soil compaction and/or soil stabilization with a compaction tool in a first position.

An operational sequence of the method for soil compaction and/or soil stabilization by means of device 1 for soil compaction and/or soil stabilization is illustrated schematically in FIGS. 6 to 10. A differently designed device 1 for soil compaction and/or soil stabilization is illustrated in FIG. 11. Said device 1 has a cable excavator as holding device 5, whereby compaction tool 2 and vibration device 3 hang on a cable of the cable excavator by means of mount 4. Compaction tool 2, as illustrated in FIG. 6, is positioned at a predetermined site where the soil compaction is to be carried out, and lowered vertically up to a predetermined target sinking depth TS of, for example, 4.5 m. In so doing, ripping tools 2.1.2 are disposed in the first position, i.e., folded upward, so that they do not hamper the lowering movement and soil compaction. In this case, due to the lowering they automatically fold upward at the start of the lowering, as already described. The target sinking depth TS is determined by the particular soil to be compacted, i.e., by a specific foundation soil to be created. The particular requirements depend, inter alia, on a specific building or structure which is to be constructed on the foundation soil, and on the soil condition of the particular soil to be compacted.

The lowering, i.e., the penetration of compaction tool 2 into the soil, occurs due to the lowering force. At least one part of the lowering force results from the self-weight of compaction tool 2, which after compaction tool 2 is set down on the ground presses down totally on a soil area under tool head 2.1. Advantageously, a force effect occurs in addition by holding device 5 on compaction tool 2, so that the lowering force comprises the self-weight of compaction tool 2 and this additional force effect by holding device 5.

Expediently, mount 4 is connected to a drive of holding device 5, by which it is to be lifted and especially also lowered under power, for example, by at least one traction cable. The traction cable can be connected, for example, to a hydraulic unit of holding device 5, for example, of the excavator or crane. In this way, a force effect is to be transferred to mount 4 and via the mount to compaction tool 2 by the drive of holding device 5, i.e., for example, by a suitable lowering drive of the excavator or crane. This force acts vertically downward on compaction tool 2. In the extreme case, in this way all or almost all of the self-weight of device 1, with the exception of the self-weight of compaction tool 2, acts on compaction tool 2. This can have the result that during the lowering of compaction tool 2 holding device 5 is raised at least partially from the ground. The lowering force therefore comprises the self-weight of compaction tool 2 and the particular force effect by holding device 5 on compaction tool 2. The maximum possible lowering force then corresponds to the self-weight of the entire device 1 or at least almost to said self-weight.

The lowering force, with which compaction tool 2 is lowered in this way, can be, for example, up to 20 tonnes or also up to 30 tonnes. In this way, a lowering pressure PE from tool head 2.1 acts on the soil via the lowering of compaction tool 2 onto the soil. In addition, vertically acting vibration movements of compaction tool 2 are generated by the attached vibration device 3, as a result of which a vibration pressure PV also acts on the soil via tool head 2.1. A strength of the vibration pressure PV can be advantageously preset via vibration device 3. The lowering pressure PE and the vibration pressure PV during the time course t of the process are illustrated in FIG. 12.

As a result of this, compaction tool 2 sinks successively into the ground to the predetermined target sinking depth TS, whereby soil material is displaced to the side and also downward by the frustoconical active surface 2.1.1 of tool head 2.1 and already compacted in this manner. Soil material VBM compacted in this way forms the foundation soil column BS after the method has been successfully carried out. A column channel SP, which in this stage of the process still has a hollow space, is created by the penetration of compaction tool 2.

Figure 7:
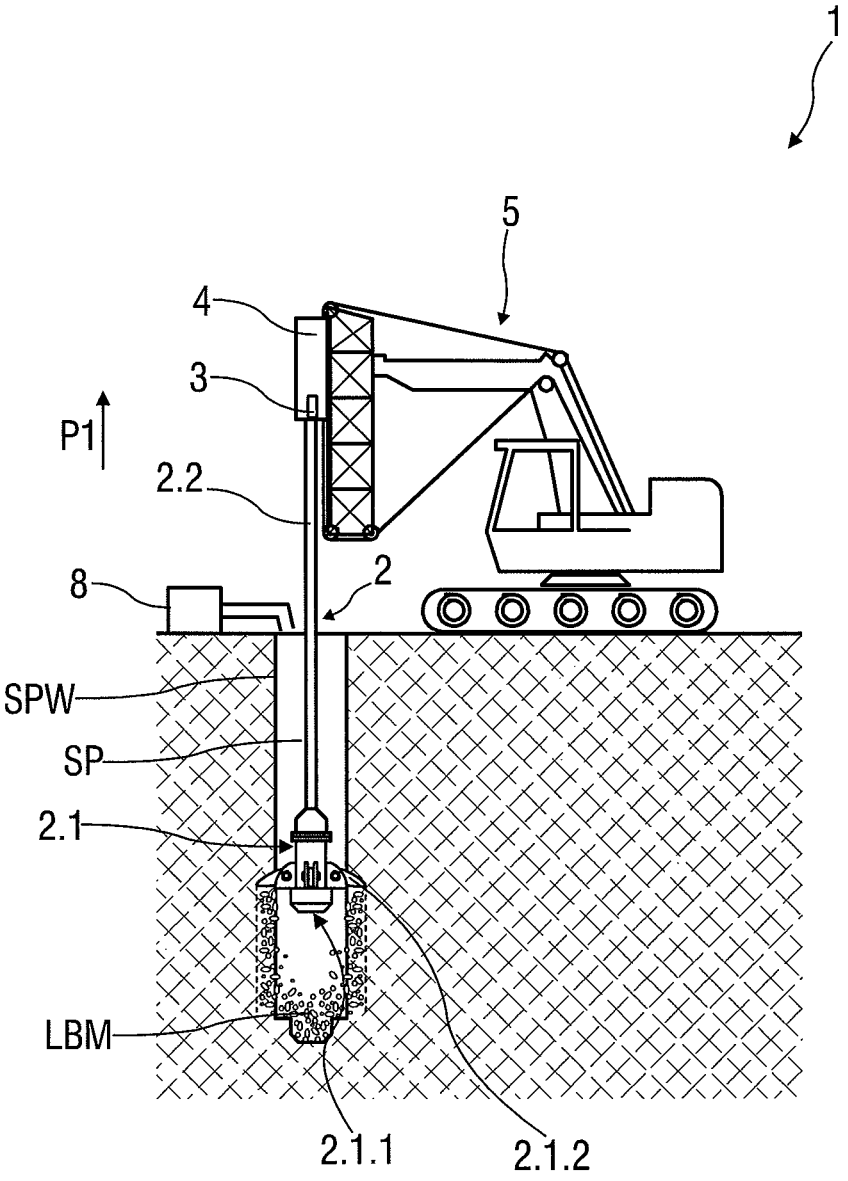
FIG. 7 shows schematically a device for soil compaction and/or soil stabilization with a compaction tool in a second position.
Figure 8:
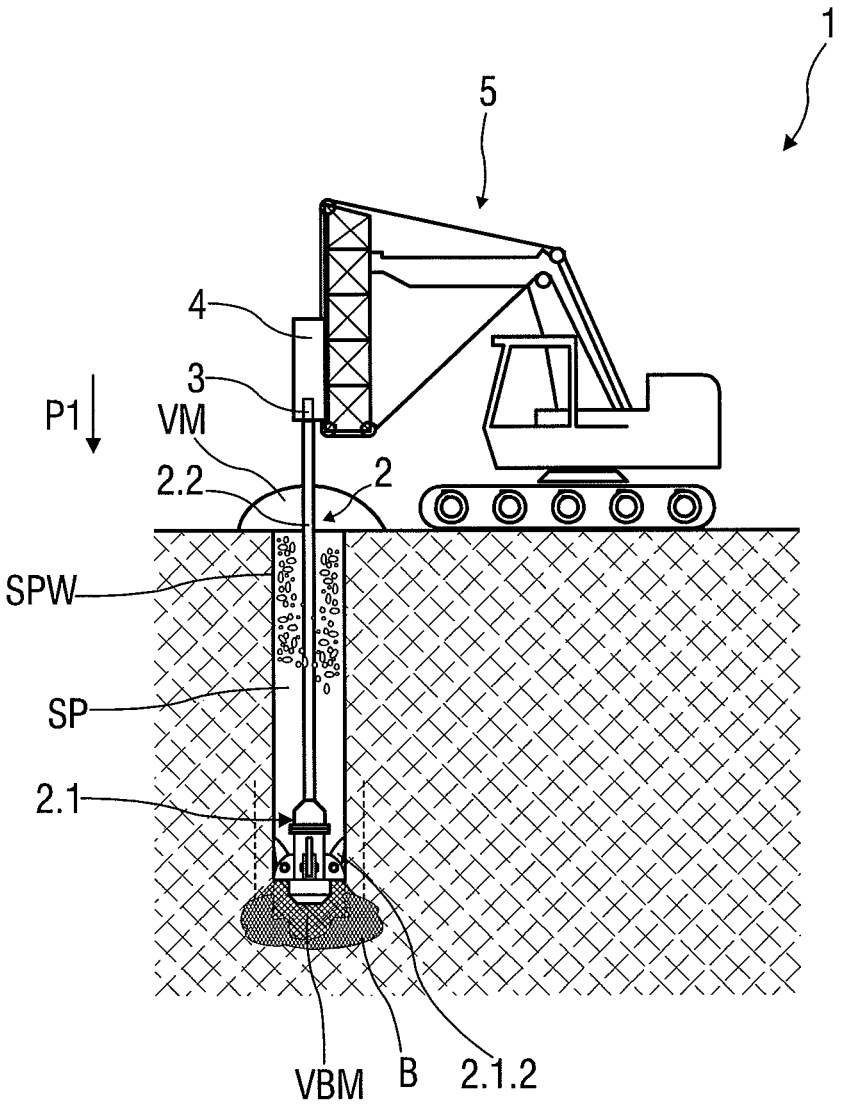
FIG. 8 shows schematically a device for soil compaction and/or soil stabilization with a compaction tool in a third position.

If tool head 2.1 has reached the predetermined target sinking depth TS, then it is again lifted by a predetermined lifting height H, for example, by 50 cm to 80 cm, as illustrated in FIG. 7. This occurs by means of holding device 5, to which compaction tool 2 is attached, i.e., by means of the excavator or crane. During the lifting of compaction tool 2, vibration device 3 can be turned off or remain on. By lifting of compaction tool 2, at the beginning of the lifting, ripping tools 2.1.2 pivot in the above-described manner automatically into the second position; i.e., they fold downward so that they jut out laterally beyond tool head 2.1.

By these downward folded ripping tools 2.1.2 during the lifting of compaction tool 2 by the predetermined lifting height H, soil material is broken out of the side column channel wall SPW and falls as loose soil material LBM into the hollow space of the column channel SP under tool head 2.1.

In order to promote the breaking out of the soil material from the side column channel wall SPW, preferably after the lifting of compaction tool 2 by the predetermined lifting height H and before a subsequent lowering of compaction tool 2, there is a pause for a predetermined time period, for example, a few seconds, in the lifted position in the case of an activated vibration device 3, so that loose soil material LBM can collapse and come under tool head 2.1.

After compaction tool 2 has been lifted by the predetermined lifting height H, as illustrated in FIG. 8, it is again lowered with vibration device 3 turned on, so that again the lowering pressure PE and the vibration pressure PV act via tool head 2.1 on the soil and the loose soil material LBM that has broken out of the side column channel wall SPW is compacted. By the lowering of compaction tool 2, at the beginning of the lowering, ripping tools 2.1.2 are again pivoted automatically back to the first position, i.e., again folded upward and against compaction tool 2. In this way, they do not hamper the lowering motion and the soil compaction. Compaction tool 2 is lowered until a predetermined resistance acts against the lowering. This is already the case even before the target sinking depth TS, because now additional loose soil material LBM, which is to be compacted, is located in the hollow space of the column channel SP under tool head 2.1. I.e., the target sinking depth TS is no longer reached with this repeated lowering of compaction tool 2.

Figure 9:
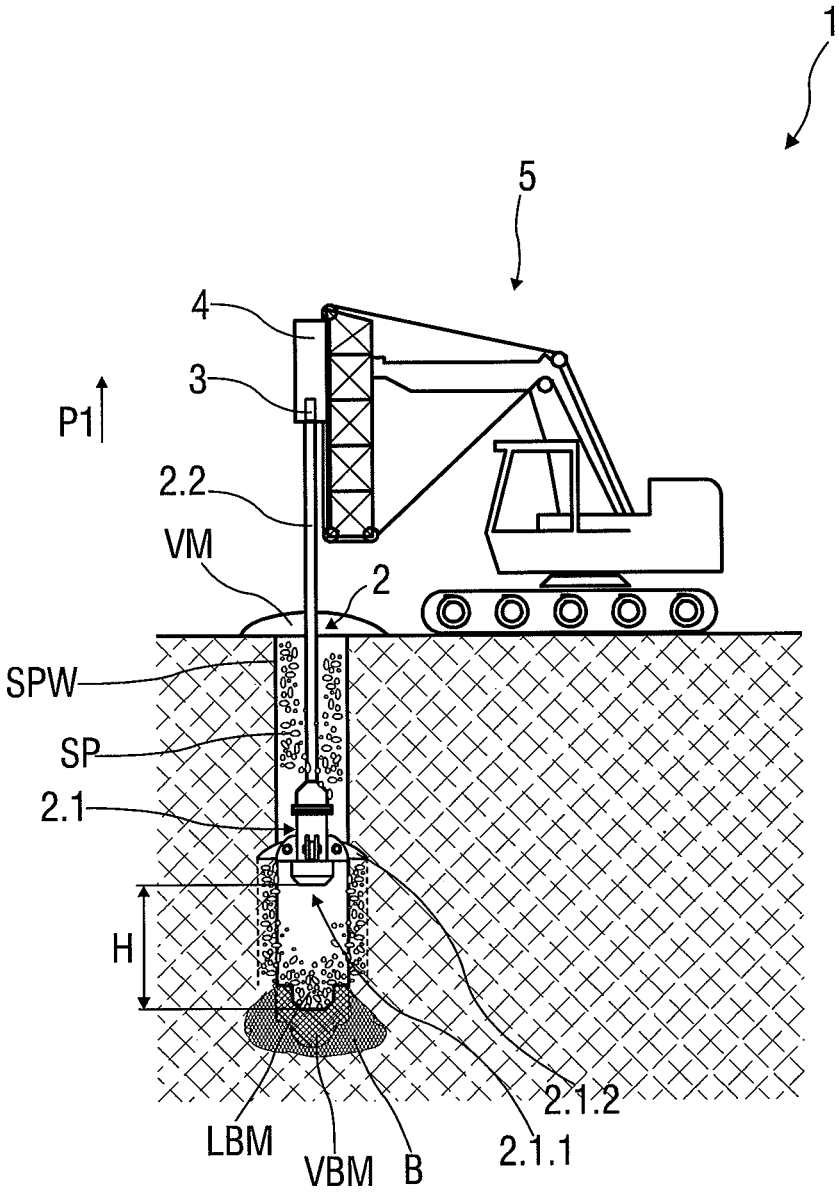
FIG. 9 shows schematically a device for soil compaction and/or soil stabilization with a compaction tool in a fourth position.

During the subsequent lifting and lowering processes, the predetermined resistance already acts against the lowering of compaction tool 2 in the described manner, before a sinking depth T of a previous lowering is reached, because, as illustrated in FIG. 9, constantly more soil material is loosened from the side column channel wall SPW by ripping tools 2.1.2 and collects as a loose soil material LBM from the side column channel wall SPW in the still present hollow space of the column channel SP under tool head 2.1 and is compacted by said tool head. The predetermined resistance and/or the vibration pressure PV are predetermined such that compaction tool 2 is then again lifted, when a sufficient compaction of the soil material VMB, compacted by compaction tool 2, under tool head 2.1 is achieved. By the use of a compaction tool 2 which has a high or low self-weight and is matched to the particular soil to be compacted, and/or by the use of an accordingly heavy holding device 5, for example, an excavator or crane with a high self-weight, the lowering pressure PE acting on the soil to be compacted can also be predetermined according to the particular requirements.

Acting against the predetermined resistance during the repeated lowering is to be taken to mean that a predetermined lowering rate is fallen short of or that a minimum value of a lowering path is no longer achieved within a predetermined time interval. This can be determined, for example, automatically, for example, by suitable sensors. Alternatively, this can also be determined by an operator of device 1.

The process steps of the lifting of compaction tool 2 in each case by the predetermined lifting height H, whereby soil material is broken out from the side column channel wall SPW by the folded ripping tools 2.1.2, i.e., pivoted into the second position, which in this second position laterally jut out beyond tool head 2.1, and as loose soil material LBM falls into the hollow space of the column channel SP under tool head 2.1, and the subsequent lowering of compaction tool 2 until the predetermined resistance acts against it, are repeated so often until the predetermined resistance acts against the lowering, when compaction tool 2 is located at a predetermined end position EP, which is illustrated in FIG. 10. This predetermined end position EP is normally located in the area of the soil surface or close to the soil surface, in order to achieve a foundation soil that is stable both at the surface and at greater depths.

I.e., a recurring lifting occurs, which can be carried out with or without vibration movements, therefore with a turned-on or turned-off vibration device 3, and during which ripping tools 2.1.2 are constantly pivoted into the second position, i.e., are folded, and lowering occurs with a turned-on vibration device 3 with compaction of the loose soil material LBM, i.e., with the formation of the compacted soil material VBM, whereby ripping tools 2.1.2 are constantly pivoted into the first position, i.e., folded upward. A steady material buildup with compacted soil material VBM occurs in the column channel SP due to such an oscillating or alternating up-and-down movement, so that the extremely compacted column channel SP, i.e., the column channel SP with extremely compacted soil material VBM, is formed stepwise in the direction of a soil surface.

In FIG. 10, the column channel SP is filled with compacted soil material VBM, so that the foundation soil column BS is formed from extremely compacted soil material VBM up to the predetermined end position EP of compaction tool 2. Because, as already mentioned, the radial expansion of the displacement and compaction effect on the soil material due to the frustoconical active surface 2.1.1 of tool head 2.1 is at least twice to three times the cone diameter DK of tool head 2.1, as illustrated in FIGS. 6 to 10, and an area affected by the compaction effect B also forms around the foundation soil column BS.

The vertical lowering pressure PE of compaction tool 2 due to the lowering force, which results from the self-weight of compaction tool 2 and preferably in addition from holding device 5 acting on compaction tool 2, which presses compaction tool 2 downward, and the additionally acting vertical vibration pressure PV, which is preferably high-frequency due to the high-frequency vibration movements of compaction tool 2, generated by vibration device 3, are transmitted by top surface 2.1.1.2 of the frustoconical active surface 2.1.1 of tool head 2.1 vertically and at the slanting tool head surfaces, formed by the cone lateral surface 2.1.1.1, of the active surface 2.1.1 by the force pairs formed there with horizontal and vertical force direction components both vertically and horizontally into the foundation soil, i.e., in the ground to be compacted. In this way, the soil compaction occurs both under compaction tool 2 and also to the side of compaction tool 2, so that the column channel SP filled with compacted soil material VBM, i.e., the finished foundation soil column BS, has a larger diameter than compaction tool 2 or its tool head 2.1.

The compaction of the soil by compaction tool 2 thereby occurs not only due to vibrations of vibration device 3, but additionally also due to a high compressive force, namely, due to the lowering force, with which compaction tool 2 is lowered. This additional compressive force, i.e., the lowering force with which compaction tool 2 is lowered, as already mentioned, can be, for example, up to 20 tonnes or also up to 30 tonnes. The soil compaction occurs in this way by means of device 1 and by the method due to a full displacement, due to the vibration movements, and the resulting vibration pressure PV and due to the additional high compressive force, from which a corresponding lowering pressure PE results.

A so-called displacement wave occurs by this method in the foundation soil, whereby it already begins at the ground surface, because the foundation soil columns BS are generated by a mounted vibration device 3 and compaction tool 2 at the beginning of the process is lowered from the ground surface by the lowering pressure PE and the vibration pressure PV to the target sinking depth TS. In this case, due to the compaction of the soil material and the slipping and compaction of this slipped loose soil material LBM as well, depending on the bulk density of the soil a crater formation in the area of the ground surface above the soil compression can result, as illustrated by way of example in FIG. 10.

When necessary, this depression cone AT forming due to the soil compaction on the ground surface above the soil compaction is filled expediently during and/or after the soil compaction by compaction tool 2 with a compactible material VM, for example, with a readily compactible mineral such as gravel in mixed round grain form or mixed crushed grain form, which corresponds to or is similar to the soil material to be compacted. This occurs, as illustrated here by way of example in FIGS. 8 and 9, preferably without delay during the process, so that a too large depression cone AT, hollow spaces, and too great material loss do not occur at the ground surface. The material addition occurs from outside into the forming depression cone AT.

A time course of the lowering pressure PE, the vibration pressure PV, and the sinking depth T over the course of the process is shown schematically in FIG. 12. These are constantly determined and monitored during the process. As a result, it can be determined immediately when the predetermined resistance acts against the lowering of compaction tool 2, so that it must be lifted again. This is the case, for example, when at a maximum acting lowering pressure PE and at a predetermined maximum vibration pressure PV no further lowering or at least no significant further lowering of compaction tool 2 can be noted. Further, the lifting of compaction tool 2 in each case by the predetermined lifting height H can be monitored and it can be determined when the predetermined end position EP of compaction tool 2 is reached and the process can be ended.

This continuous determination of the lowering pressure PE, the vibration pressure PV, and the sinking depth T during the process enables in addition an evaluation for quality assurance. It can be evaluated thereby whether the soil compacted in this way and the foundation soil produced thereby meet the particular requirements, i.e., for example, have a sufficient bearing capacity, strength, and stability, to carry out the planned construction measures on the foundation soil, for example, to construct a structure or building thereon.

The method is a full displacement technique for subsoil improvement. In this case, a bulk density of an existing foundation soil is significantly increased. In this regard, in contrast to the full displacement and partial displacement technique, known from the state of the art, preferably no additional stone material is introduced from the outside into the column channel SP forming during the process, rather this is filled with soil material.

An extremely high driving energy of vibration device 3 set on compaction tool 2, for example, a vibrator attachment, due to the full displacement process has the effect that the soil material, for example, the gravel, is rammed and pressed laterally into a soil matrix and thereby compaction and densification of the soil and a reduction of a pore fraction are brought about. Because of the frustoconical active surface 2.1.1 of tool head 2.1 and the vertical vibration movement of compaction tool 2, a predominantly vertical force transmission occurs in the column channels SP, so that extremely rigid foundation soil columns BS can be produced which have comparable properties as foundation soil columns produced by means of methods and devices according to the state of the art.

The foundation soil improvement is therefore achieved solely by a redistribution and compaction of the existing foundation soil. In this case, a compacted foundation soil column BS, i.e., a column channel SP filled with compacted soil material VBM, is created, which as a linear support member improves the foundation soil in the vicinity of the column channel SP. I.e., the soil is considerably improved by the displacement process during the introduction of foundation soil columns BS compared with an original condition.

The column channel SP filled with finished compacted soil material VBM, i.e., the finished foundation soil column BS in the ground, which was produced with use of compaction tool 2 and tool head 2.1 with a cone diameter DK of 40 cm, in the example presented here has a column diameter of about 55 cm to 65 cm. In the case of such compaction points created close to one another by the method, i.e., in a plurality of such foundation soil columns BS, for example, linear or in a sheet-like grid and, for example, at a distance of one meter to one another, complete homogenization of the soil with a considerably increased density and higher shear strength and stiffness results.

Because the compacted foundation soil columns BS of soil material produced by the method are full displacement columns, the method is to be used preferably in water-saturated, loose to medium dense packed sand and gravel with minor fine-grained fractions. The method brings about the homogenization and compaction of sand and/or gravel. In the case of the soil compaction and/or soil stabilization with binders, the foundation soil columns BS have a substantially higher load capacity, which at greater diameters of compaction tool 2 can reach values of over 800 kN to 1500 kN.

A further embodiment of compaction tool 2 is illustrated in FIG. 5. Both the first embodiment, illustrated in FIGS. 1 to 4, and the second embodiment, illustrated in FIG. 5, are to be used in the method, which is illustrated in FIGS. 6 to 10. In the embodiment illustrated in FIG. 5, the compaction tool has a plurality of outlet openings 7. Said outlet openings 7 are used to supply at least one fluid medium into the column channel and/or into an adjacent soil area. The fluid medium can be, for example, water, air, or another gas or gas mixture, a hydraulic binder, for example, bentonite or a bentonite-cement suspension or cement, limestone, or mixtures of these substances. This at least one fluid medium is supplied to outlet openings 7 by means of an external equipment unit 8, which is connected to feed lines 9 of compaction tool 2. Outlet openings 7 are preferably to be opened and closed by a valve, for example, by a ball valve. In this embodiment of compaction tool 2, the bottom end of compaction tool 2 and the frustoconical active surface 2.1.1, with the exception of outlet openings 7, are completely closed and outlet openings 7 are also to be closed expediently by valves.

Outlet openings 7 in the shown example are formed in the tool head, namely, both in the frustoconical active surface 2.1.1 and in the vertical side walls of the tool head above and below ripping tools 2.1.2. The soil becomes additionally stabilized and/or impermeable by the introduction of at least one fluid medium formed as a binder. To improve the compaction process, it can be useful or necessary to fill water as the fluid medium into the column channel SP.

Feed lines 9 in hollow compaction tool 2 shown here are run in compaction tool 2 and in the area of a top end of columnar base body 2.2 below the mounted or to be mounted vibration device 3 brought out through an opening from the columnar base body 2.2, in order to connect them to equipment unit 8. In a columnar base body 2.2 of compaction tool 2, which has no hollow interior, feed lines 9 are to be run on the outside. The fluid medium is supplied via the compaction tool to column channel SP preferably under pressure. Alternatively or in addition, as is illustrated by way of example in FIG. 7, at least one such fluid medium, for example, water or a hydraulic binder, is filled directly from above by means of a hose into the column channel. This then occurs expediently without pressure, likewise by means of an external equipment unit 8. The external equipment unit 8 has, for example, a pump and, if necessary, a mixing unit to mix the suspension of the hydraulic binder.

In an embodiment not shown here in greater detail, compaction tool 2 may have alternatively or in addition a so-called vacuum lance, which is connected to a suction device. A negative pressure is to be produced thereby in the column channel, as a result of which a pressure relief in the ground water is to be achieved in the soil area to be compacted.

A further embodiment of device 1, by which the process according to FIGS. 6 to 10 is also to be carried out, is illustrated in FIG. 11. In this embodiment, holding device 5 is formed as a cable excavator. Compaction tool 2, on whose top end vibration device 3 is placed, is thereby connected to a cable of the cable excavator by means of mount 4, so that it hangs freely on this cable.

The area of application of, for example, holding devices 5, formed as a supporting caterpillar, with leaders, as illustrated in FIGS. 6 to 10, is limited. For this reason, in the case of compaction depths to be achieved of over 20 m, for example, at compaction depths of up to 25 m, 30 m, or 40 m, tool head 2.1 is mounted on a very long driven tube, so that accordingly a very long compaction tool 2 is formed. Vibration device 3 is mounted at the top on compaction tool 2, i.e., on the upper end of the driven tube. In this variant of device 1 for soil compaction and soil stabilization, the lowering force includes the self-weight of the column-shaped compaction tool, which comprises the driven tube, and the self-weight of vibration device 3. Compaction tool 2, which comprises the driven tube, and vibration device 3 in this case hang freely on the cable. For example, a cable excavator is used as holding device 5, which is also called supporting device. As soon as compaction tool 2 is placed on the ground, vibration device 3 is started, so that compaction tool 2 is driven into the ground up to the target sinking depth by the lowering pressure PE, formed by the self-weight of compaction tool 2 and vibration device 3, and by the vibration pressure PV by the action of vibration device 3, i.e., by the vibrations, oscillations, and/or hammering thereof by lowering of the cable, lifted again, and then lowered and lifted again so often until the soil is compacted up to the surface or close to the surface. In so doing, compaction tool 2 because of the very long driven tube has a very high self-weight, so that the lowering force, for example, corresponds to the lowering force achievable with the leader device.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for soil compaction and/or soil stabilization of sand or gravel, the device comprising:

a column-shaped compaction tool; and a vibration device, the compaction tool adapted to be lowered vertically into a soil area to be compacted, which is to be compacted by vibrations of the compaction tool, the compaction tool being substantially closed at least at one bottom end to be lowered into the soil area and the vibration device being configured to be placed at an upper end on the compaction tool, wherein the compaction tool is moveable only in the vertical direction by the vibration device, wherein the compaction tool at its bottom end has a tool head on which at least one ripping tool is arranged, which is pivotable around a horizontal pivot axis into a first position and into a second position, wherein, in the first position, the at least one ripping tool is oriented substantially parallel to the compaction tool and in the second position is oriented substantially radially to the compaction tool and radially projects beyond a diameter of the tool head.

2. The device according to claim 1, wherein the tool head has a substantially closed frustoconical active surface.

3. The device according to claim 1, wherein a plurality of ripping tools are disposed uniformly distributed on the tool head over its circumference.

4. The device according to claim 1, further comprising a holding device on which the compaction tool is arranged vertically movable, wherein the compaction tool is configured to be lowered via a drive of the holding device in such a way that via the drive of the holding device during the lowering at least at times a force acts on the compaction tool in the lowering direction.

5. The device according to claim 1, wherein the compaction tool has at least one outlet opening for at least one fluid medium.

6. A method for soil compaction and/or soil stabilization of sand or gravel by the device according to claim 1, wherein a column-shaped compaction tool is lowered vertically into a soil area to be compacted and vibrations are generated by means of a vibration device in the compaction tool, in order to compact the soil area, wherein vertical vibration movements of the compaction tool are generated by the vibration device, which is placed on a top end of the compaction tool, wherein the compaction tool is lowered to a predetermined target sinking depth by a lowering force and by the vibration movements and then lifted at least once by a predetermined lifting height and due to the lowering force and the vibration movements again lowered until a predetermined resistance acts against the renewed lowering, wherein at least one ripping tool, disposed on a tool head at a bottom end of the compaction tool is pivoted by the lowering of the compaction tool into a first position, in which it is oriented substantially parallel to the compaction tool, and is pivoted by the lifting of the compaction tool into a second position, in which it is oriented substantially radially to the compaction tool and radially projects beyond a diameter of the tool head, wherein, via the at least one ripping tool during the lifting of the compaction tool, a column channel wall is broken up and soil material is loosened out of the column channel wall.

7. The method according to claim 6, wherein the lifting of the compaction tool by the predetermined lifting height and subsequent lowering are repeated alternatingly so often until the predetermined resistance acts against the lowering, when the compaction tool is located at a predetermined end position.

8. The method according to claim 6, wherein a depression cone forming due to the soil compaction on a ground surface above the soil compaction is filled during and/or after the soil compaction carried out by the compaction tool with a compactible material.

9. The method according to claim 6, wherein a lowering pressure acting via the compaction tool on the soil area to be compacted, an acting vibration pressure and a sinking depth of the compaction tool are determined.

10. The method according to claim 6, wherein after the lifting of the compaction tool by the predetermined lifting height and before the subsequent lowering of the compaction tool there is a pause for a predetermined time period in the lifted position in the case of an activated vibration device, so that soil material can collapse and come under the tool head.

11. The method according to claim 6, wherein the compaction tool is lowered by a drive of a holding device on which the compaction tool is disposed vertically movable, in such a way that by use of the drive of the holding device during the lowering at least at times a force acts in the lowering direction on the compaction tool.

12. The method according to claim 6, wherein at least one fluid medium is introduced into a column channel and/or into a soil area adjacent to the column channel.

* * * * *